United States Patent [19]

Lewis

[11] Patent Number: 4,623,124

[45] Date of Patent: Nov. 18, 1986

[54] PORTABLE HYDRAULIC POWER UNIT

[76] Inventor: Earl R. Lewis, 825 S. Hill Dr., Reedsport, Oreg. 97467

[21] Appl. No.: 737,720

[22] Filed: May 28, 1985

[51] Int. Cl.[4] ..... B66D 1/14; B66D 1/08

[52] U.S. Cl. ..... 254/350; 254/361

[58] Field of Search ..... 254/346, 350, 361, 365, 254/380

[56] References Cited

U.S. PATENT DOCUMENTS

| | | | |
|---|---|---|---|
| 1,143,547 | 6/1915 | McGiffert | 254/346 |
| 2,873,948 | 2/1959 | Colmer | 254/346 |
| 3,015,473 | 1/1962 | Frellsen | 254/361 X |
| 3,788,605 | 1/1974 | Johnson | 254/361 |
| 3,802,511 | 4/1974 | Good | 224/148 X |
| 3,836,122 | 9/1974 | Pierce | 254/361 X |
| 3,938,781 | 2/1976 | Craven | 254/342 |
| 4,145,028 | 3/1979 | Kelley | 254/380 X |
| 4,189,075 | 2/1980 | Hall | 224/148 |
| 4,290,584 | 9/1981 | Eckels | 254/380 |

*Primary Examiner*—Stuart S. Levy

*Assistant Examiner*—Katherine A. Matecki

*Attorney, Agent, or Firm*—Klarquist, Sparkman, Campbell, Leigh & Whinston

[57] ABSTRACT

A hydraulic power unit includes an engine and a pump mounted to a portable frame having an integral fluid reservoir for circulating the hydraulic fluid. Detachably mounted to the frame is a multiple speed winch. The fluid reservoir within the frame comprises the hollow structural tubing of the frame itself. The frame includes a handle for carrying the unit while the winch is in operation and for providing a hydraulic head to the pump and an expansion chamber for the hydraulic fluid. The multiple speed winch includes, in addition to the hydraulic motor, a first rotatable shaft and a second rotatable shaft operatively connected to the motor for providing two speeds to the winch. Each shaft has a freely rotatable hub mounted thereon which is engaged to its shaft by an associated clutch. By engaging and disengaging the clutches, the hydraulic motor may drive either of the shafts directly to reel in the attached cable or play it out.

6 Claims, 7 Drawing Figures

FIG. 5
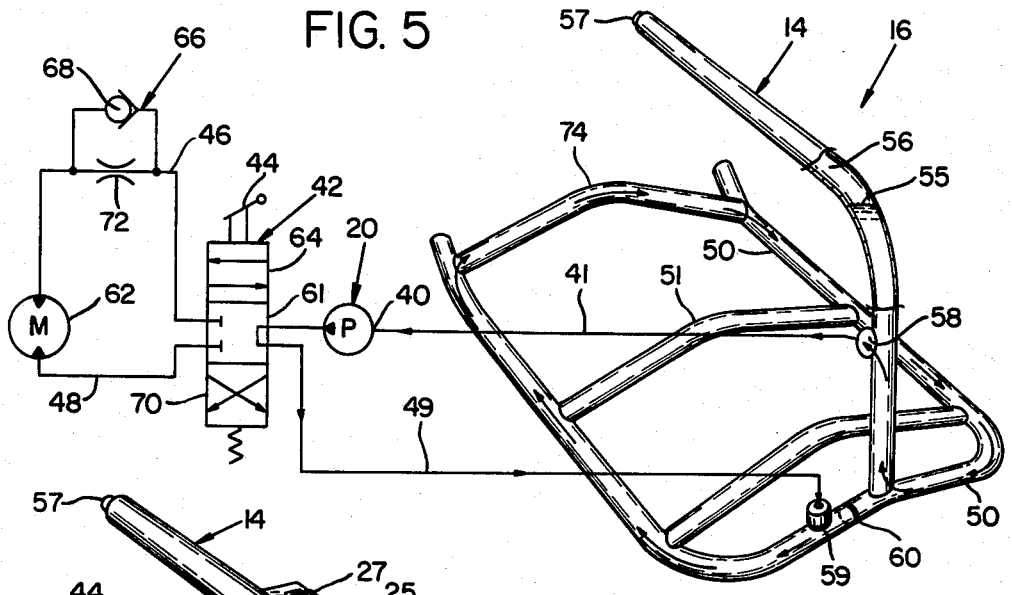
FIG. 3
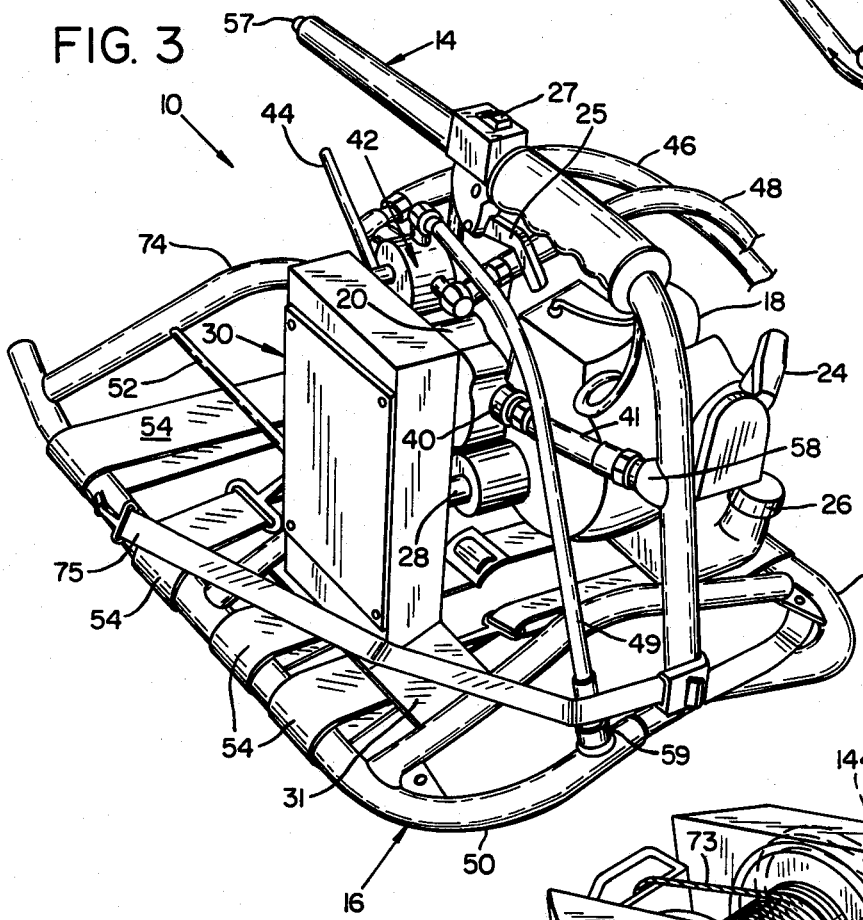
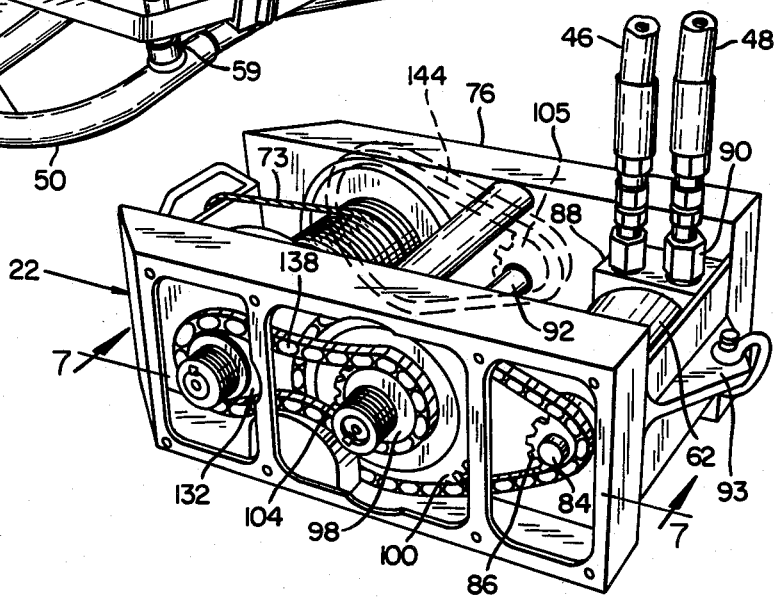
FIG. 6

PORTABLE HYDRAULIC POWER UNIT

BACKGROUND OF THE INVENTION

This invention relates to portable mechanical power units and more particularly, relates to a portable hydraulic power unit that can be manually carried while in operation.

Portable power units are of use where it is impractical to draw power from a larger, more powerful fixed power source. They are typically used for jobs such as cutting, hauling, etc., where the power source is mobile to perform its function. Portable units of this type that can be manually carried while in operation generally include a small gasoline engine with a chain drive.

Although its light weight makes it an attractive portable power unit, a chain-driven unit suffers from several drawbacks. It cannot provide power to as many types of tools as a hydraulic unit can. Nor can it provide power to a mobile tool remote from the engine. Hydraulic units heretofore available, however, have not been able to be manually carried while in operation, primarily because of their relatively large weight and size.

A need, therefore, remains for a portable power unit that can be manually carried in operation and can be used to lift and transport heavy loads over different terrain. For example, such a unit could be used for hauling game from remote areas inaccessible to a vehicle.

SUMMARY OF THE INVENTION

It is an object of the present invention to provide a hydraulic power unit that can be manually carried while in operation.

It is another object of the present invention to provide a hydraulic power unit in which the fluid reservoir is incorporated into a frame supporting the unit.

It is yet another object of the present invention to provide a power hydraulic unit that includes a detachable mutiple speed winch powered by the unit.

To achieve these objects, a portable hydraulic power unit according to the invention includes power means for providing hydraulic fluid under pressure and portable frame means supporting the power means and adapted to be manually carried. The frame means includes integral fluid reservoir means for circulating the hydraulic fluid for optimum cooling. Detachably mounted to the frame means and connected to the power means is a hydraulic tool means.

In one embodiment of the invention, the fluid reservoir means comprises the hollow structural tubing forming the frame itself. No additional tank is required. The tubing is spaced sufficiently apart to expose the circulating fluid sufficiently to ambient temperatures for rapidly cooling it before the fluid circulates through the power means.

The frame may also include a handle means for hand carrying the power unit while the tool means is in operation. The handle may also provide a hydraulic head to the power means and an expansion chamber for the hydraulic fluid.

The tool means in one embodiment is a multiple speed hydraulic winch. It may include in addition to a hydraulic motor a first rotatable shaft having first and second gearing means mounted thereon on opposite ends of the shaft. The first gearing means is operably connected to the hydraulic motor means and is freely rotatable about the first shaft, and the second gearing means is affixed to the shaft for rotation therewith. A second rotatable shaft having third and fourth gearing means on its opposite ends is also mounted within the winch. The third gearing means is operably connected to the first gearing means and freely rotatable about the second shaft. The fourth gearing means is operably connected to the second gearing means and is fixed to the second shaft for rotation therewith. First and second clutch means associated with each shaft are operable to engage one of the freely rotatable gearing means to its respective shaft. The speed of the winch may be changed by engaging either of the first and second clutch means to deliver power from the hydraulic motor to either the first shaft or the second shaft.

The clutch means in this embodiment may comprise resilient frictional means adjacent the freely rotatable gearing means and pressure means rotatably fixed to each shaft for urging the frictional means toward the gearing means to engage the gearing means to the pressure means and thereby to rotate the shaft.

The foregoing and other objects, features, and advantages of the invention will become more apparent from the following detailed description of a preferred embodiment which proceeds with reference to the accompanying drawings.

BRIEF DESCRIPTION OF THE DRAWINGS

FIG. 3 is a perspective view of the power unit with the winch detached.

FIG. 5 is a schematic view of the hydraulic system and frame.

FIG. 6 is a perspective view of the winch employed in the unit.

DETAILED DESCRIPTION

Figure 2:
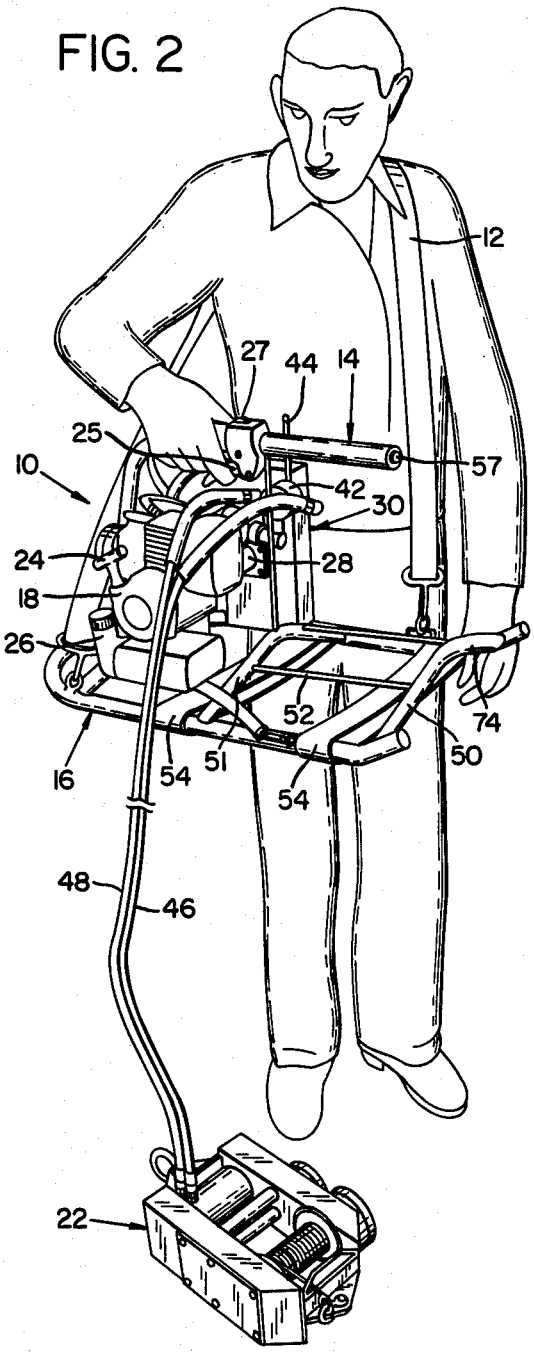
FIG. 2 is a second pictorial view of the power unit in use.
Figure 1:
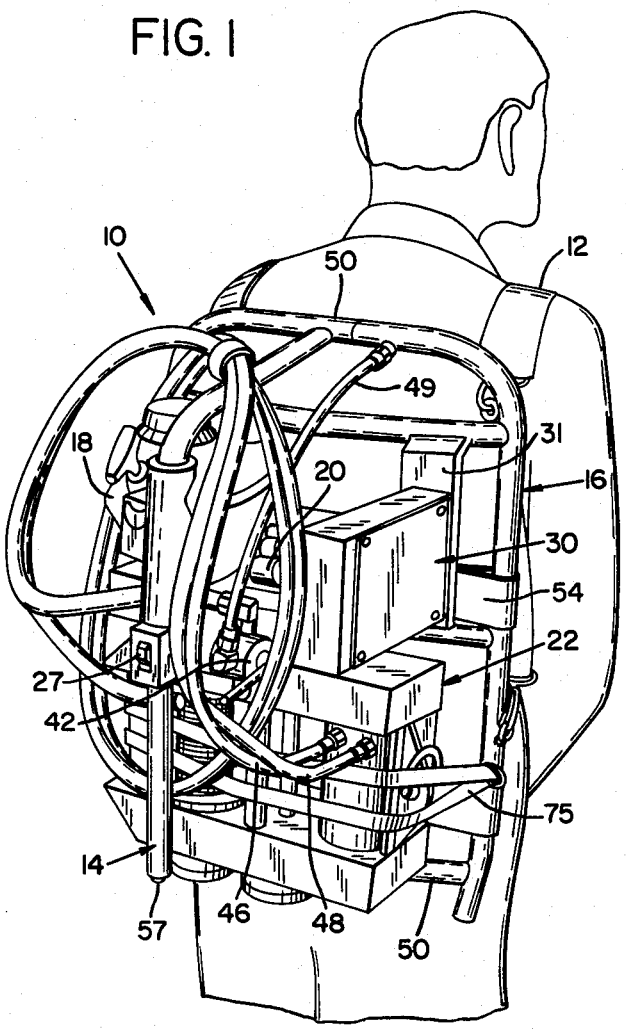
FIG. 1 is a pictorial view of a hydraulic power unit according to the present invention.

A portable hydraulic power unit 10 according to the invention is illustrated in use in FIGS. 1 and 2. As shown, the unit is of a size that can be manually carried by the operator as a backpack when not in operation and with a shoulder strap 12 or handle 14 while in operation.

The unit comprises generally a fluid reservoir frame 16 to which is attached a power means such as a gasoline engine 18 and hydraulic pump 20 and to which is detachably mounted a tool means such as a hydraulic winch 22. Referring particulary to FIG. 1, the winch is shown detached for connection to a load, with the operator able to move along with the load and unit. In FIG. 2, winch 22 is shown mounted snugly to the lower portion of frame 16 for ease of transport. Although a winch is shown, the tool means could also be a hydraulic jack or other hydraulic tool.

Unit 10 is further shown in perspective in FIG. 3, with the winch detached for clarity. Engine 18 is mounted to frame 16 and forms a portion of the unit's power means for providing hydraulic fluid under pressure. It is of conventional design and comparable to the ECHO engine Model No. 4200 sold by Kioritz Co. of Japan and found on lawn implements. This engine includes a pull starter 24 and a gasoline tank 26 and is controlled by a throttle 25 and grounding switch 27. The power of the engine is directed to a drive shaft 28 which extends from the engine into a gearbox 30.

Figure 4:
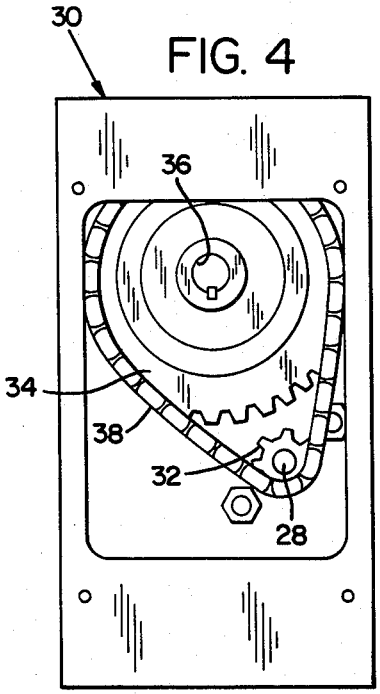
FIG. 4 is a side view of a gearbox of the unit with the gearbox cover removed.

Power is transferred from engine 18 to pump 20 through gearbox 30, which interconnects drive shaft 28 with pump 20. The gearbox is attached to frame 16 by a bracket 31. Referring to FIG. 4, the gearbox contains a driving gear 32 mounted to the end of drive shaft 28 and a pump gear 34 keyed to the end of a pump shaft 36. The two gears are aligned and operably connected by a drive chain 38. The pitch radius of pump gear 34 is much greater than the radius of driving gear 32 so that the high speed, low power rotation of drive shaft 28 is transformed into low speed, high power rotation of pump shaft 36.

Hydraulic pump 20 is a single direction pump of conventional design, such as Model No. 15YB012-1A sold by the Webster Company. It is mounted to frame 16 and receives its power through pump shaft 36. Pump 20 includes an inlet 40 for drawing hydraulic fluid therein through a line 41 connected to the frame and an outlet (not shown) for directing the fluid from the pump to an attached three-position valve 42. The valve, shown schematically in FIG. 5 and graphically in FIG. 3, includes a control lever 44 for shifting the valve between neutral, forward, and reverse positions. The valve connects pump 20 to winch 22 through lines 46 and 48 and also connects the pump to the frame through a return line 49.

The fluid reservoir means through which the fluid is circulated for cooling is integral with frame 16 itself. The frame is of conventional shape, having a roughly rectangular shape formed by hollow structural tubing 50 with transverse tubing 51 and lengthwise support struts 52 for support. Frame 16 also includes a plurality of adjustable webs 54 for fitting the frame to the operator's back.

In the embodiment shown, the integral reservoir comprises hollow outer structural tubing 50 of frame 16 and projecting handle 14, as shown in the schematic of FIG. 5. The tubing, handle, and support struts of the frame are composed of a strong, lightweight material such as aluminum or stainless steel. Tubing 50 roughly forms a rectangular backpack frame of spaced-apart sections for maximum cooling exposure of the fluid. Handle 14 extends outward from the upper midportion of the frame and provides to the pump a hydraulic head 55 that prevents cavitation of the pump and an expansion chamber 56 to permit the fluid to expand as it heats during the unit's operation. A stoppered inlet 57 on the end of the handle allows fluid to be poured into the reservoir as needed. Within handle 14 a fluid reservoir outlet 58 is connected to pump inlet 40 by way of line 41. An inlet 59 to the reservoir is within the tubing 50 of the frame, connected to valve 42 by return line 49. Fluid is then drawn from the frame reservoir through outlet 58 and returned through inlet 59, the outlet and inlet separated by a wall 60 adjacent inlet 59 within the upper midportion of tubing 50.

The flow of the hydraulic fluid through power unit 10 is illustrated in FIG. 5. Pump 20 draws fluid from handle 14 through outlet 58 and line 41 into pump inlet 40. Fluid is then pumped into valve 42 where it is directed either to winch 22 or is recirculated back to the reservoir, depending on the position of the valve. With the valve set in a neutral position 61, as shown in FIG. 5, the fluid flows back to the pump through line 49. Winch motor 62 in this case is braked by the stationary fluid in lines 46 and 48. With the valve set to a forward position 64, fluid flows to winch motor 62 through line 46 and returns from the motor through line 48. Line 46 includes a one-way restriction valve 66 that restricts fluid flowing from the motor but allows fluid to flow unimpeded through a check valve 68 in the forward direction. With valve 42 moved to a reverse position 70, fluid flows to motor 62 through line 48 and from the motor through line 46. Fluid flowing back through line 46 is blocked by check valve 68 and forced to flow through a constriction 72. This flow slows the rate of revolution of the winch and thereby prevents the motor 62 from overdriving pump 20. The returning fluid through line 48 enters inlet 59 on the tubing 50 and is directed through the spaced-apart tubes around the perimeter of the frame to the handle. As it circulates, the fluid rapidly cools before being drawn again through the handle 14.

Winch 22 is detachably mounted to the lower portion of the frame 16 and includes a cable 73, as shown in FIG. 2. A lower tube portion 74 of hollow tubing 50 forms a shelf on which the winch rests when in place. Straps 75 attached to frame 16 wrap around the winch to hold it securely to the frame.

Figure 7:
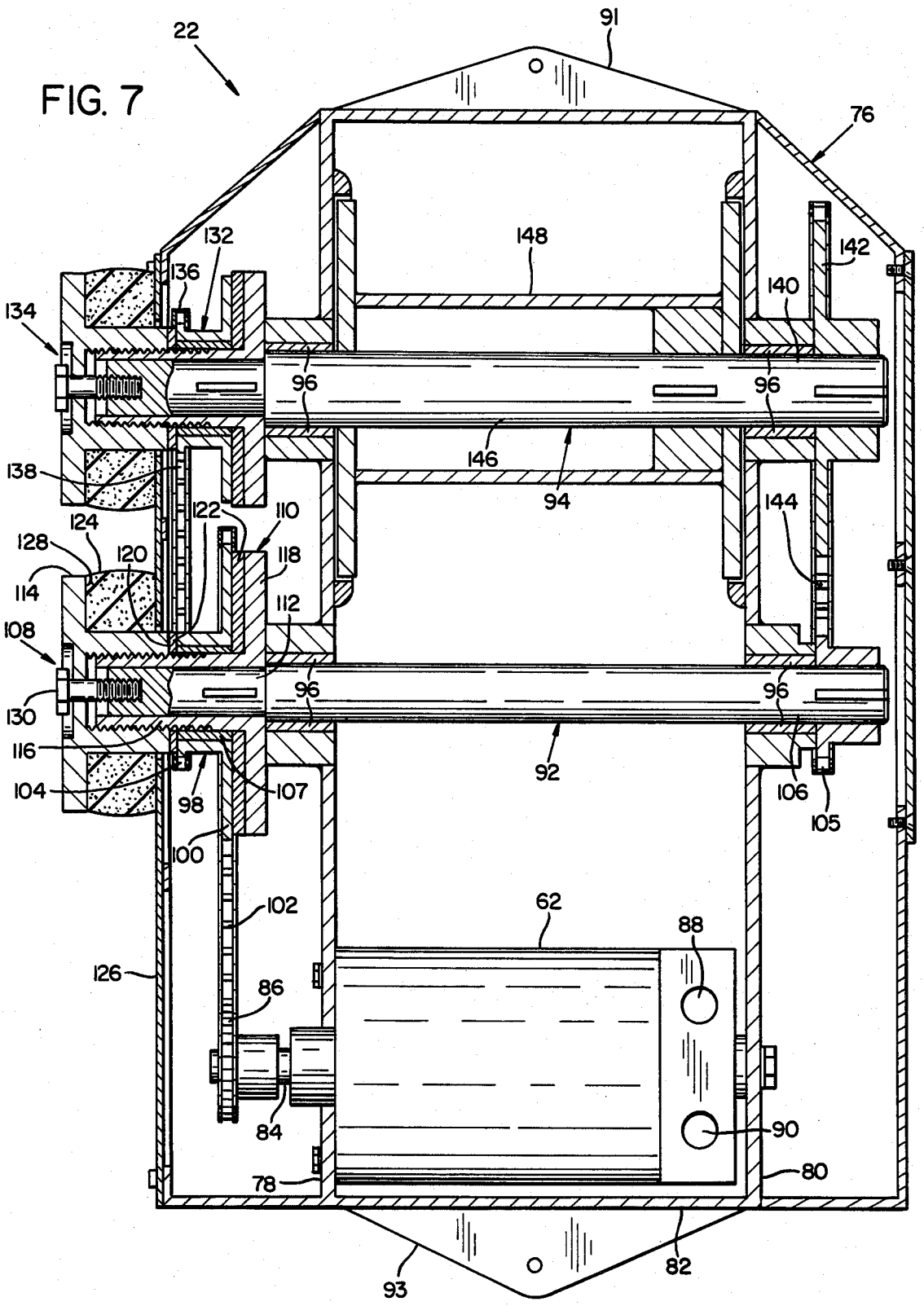
FIG. 7 is a top sectional view on line 7—7 of the winch of FIG. 6.

The structure of the winch 22 is shown in detail in FIGS. 6 and 7. Within a housing 76, hydraulic motor 62 is rotatably mounted to inner walls 78, 80 near a rear wall 82. A drive shaft 84 projects from one end of the motor 62 and has mounted thereon a driving gear 86 of low pitch radius. The motor has two ports 88, 90 for connecting it to hydraulic lines 46 and 48. It may be driven in the forward direction to reel in cable 73 and in the reverse direction to play it out. The winch may be attached to loads by opposing tongues 91, 93.

The power of the motor is transferred through a series of gears to two rotatable shafts 92, 94 mounted parallel to the motor on bearings 96 affixed to inner walls 78, 80. First shaft 92 is operatively connected to motor 62 by a hub 98 opposite driving gear 86. The hub has on one end a large pitch radius gear 100 aligned with driving gear 86 and is connected thereto by a drive chain 102. On the hub's opposite end, a parallel gear 104 connects the hub operatively to second shaft 94. Shaft 92 includes a second gear 105 keyed to its opposite end 106 for rotation with the shaft. Gear 105 is also operatively connected to second shaft 94.

Hub 98 is freely rotatable about shaft 92 on a bearing 107 until engaged to the shaft by means of a clutch 108. The clutch comprises a cylindrical flanged member 110 keyed to a shoulder end 112 of shaft 92 and a pressure handle 114 threadably attached to a shank portion 116 of member 110. Hub 98 encircles shank 116 between a flange portion 118 of the member and shoulder 120 of the threaded handle 114. The hub is spaced from flange 118 and shoulder 120 by resilient material 122. To tension the handle, the clutch further includes resilient material 124 between an outer wall 126 of housing 76 and handle head 128. A retaining bolt 130 prevents handle 114 from unthreading inadvertently.

The clutch engages the hub to shaft 92 to rotate the shaft by threading handle 114 toward the flange portion 118. As pressure is applied by the handle to resilient material 122, the material frictionally grips hub 98 on both its ends and causes the hub to become fixed to shaft 92. To declutch the hub, the handle 114 is loosened until the hub is again freely rotatable.

Second shaft 94 is of like construction to shaft 92 and has a hub 132 and clutch 134 identical to hub 98 and clutch 108 on shaft 92. Hub 132 includes a third gear 136 aligned with gear 104 on hub 98 and is operatively connected thereto by a drive chain 138. On its opposite end 140, a fourth gear 142 is keyed to shaft 94 and operatively connected to gear 95 by a drive chain 144. Within a midsection 146 of shaft 94 between inner walls 78, 80, a flanged drum 148 is keyed. The drum supports the cable 73, best seen in FIG. 6.

By tightening and loosening the two clutches, either shaft 92 or 94 can be driven by winch motor 62. The winch thus has two speeds. For a lower speed of rotation and more power, clutch 108 is engaged to rotate first shaft 92 while clutch 134 is disengaged to allow hub 132 to rotate freely about shaft 94. Hub 98 rotates shaft 92, which in turn rotates shaft 94 through gears 95 and 142. For higher rate of rotation but less power, clutch 108 is disengaged and clutch 134 is engaged. Shaft 94 is then turned by hub 132 acting through hub 98, which is freely rotatable about shaft 92.

In use, the unit is carried as a backpack to the area in which it will be operated. For example, if the unit is to be used with a winch to carry a load from a remote area, the unit will be carried in on the person's back, as indicated in FIG. 2. Once the load is ready to be hauled, the backpack is removed and winch 22 is detached from its securement to the back of the frame 16. Winch 22 may then be hooked to the load and cable 73 attached to a distant point. Other arrangements are also possible, such as using a pulley system for additional pull. The operator then adjusts the position of the frame so that he has access to the handle, using the shoulder straps for support if convenient. Engine 18 is started, and winch 22 engaged by operation of valve 42. The speed of winch 22 can be controlled by throttle 25. To shut off engine 18, the operator presses switch 27 atop handle 14. Winch 22 is then easily remounted to frame 16 and held in place by straps 75.

Having illustrated and described the principles of the invention in a preferred embodiment, it should be apparent to those skilled in the art that the invention can be modified in arrangement and detail without departing from such principles.

I claim all modifications coming within the spirit and scope of the following claims:

1. A portable hydraulic power unit, comprising:

power means for providing hydraulic fluid under pressure;

portable frame means supporting the power means mounted thereto, the frame means including hollow tubing comprising a fluid reservoir means for circulating the hydraulic fluid for cooling; and tool means detachably mounted to the frame means and hydraulically connected to and driven by the power means for operation remote from the power means while being driven by the power means; and carrying means for carrying the portable frame means and power means while the tool means is in operation.

2. The hydraulic power unit of claim 1 in which the carrying means includes a handle means for hand carrying the portable frame means and power means while the tool means is in operation.

3. The hydraulic power unit of claim 1 in which the fluid reservoir means includes a hollow handle attached to the tubing, the handle also providing a hydraulic head to the power means and an expansion chamber for the hydraulic fluid.

4. The hydraulic power unit of claim 1 in which the tool means comprises a multiple speed hydraulic winch.

5. The hydraulic unit of claim 4 in which the winch comprises:

hydraulic motor means;

a first rotatable shaft having first and second gearing means mounted thereon, the first gearing means operably connected to the hydraulic motor means and freely rotatable about the first shaft and the second gearing means fixed to the shaft for rotation therewith;

a second rotatable shaft having third and fourth gearing means mounted thereon, the third gearing means engaged with the first gearing means and freely rotatable about the second shaft and the fourth gearing means engaged with the second gearing means and fixed to the second shaft for rotation therewith; and first and second clutch means each associated with a shaft and engaging one of the freely rotatable gearing means to its respective shaft, the second shaft rotating at a first rate with the first gearing means engaged by the first clutch means to turn the first shaft and the second shaft through the second gearing means and third gearing means, and the second shaft rotating at a second rate with the first gearing means freely rotatable about the first shaft and engaged with the second gearing means which is engaged by the second clutch means to turn the second shaft.

6. The hydraulic winch of claim 5 in which the clutch comprises resilient frictional means adjacent the freely rotatable gearing means and pressure means rotatably fixed to each shaft for urging the frictional means toward the gearing means to engage the gearing means to the pressure means and thereby to rotate the shaft.

* * * * *